US011158977B2

(12) United States Patent
Nagasaka et al.

(10) Patent No.: US 11,158,977 B2
(45) Date of Patent: Oct. 26, 2021

(54) CONNECTOR INCLUDING GUIDING STRUCTURE BETWEEN COVER AND HOUSING

(71) Applicant: Yazaki Corporation, Tokyo (JP)

(72) Inventors: Naokazu Nagasaka, Shizuoka (JP); Shoichi Watai, Shizuoka (JP); Akihiro Tsuruta, Shizuoka (JP); Tohru Kurosawa, Shizuoka (JP); Masayuki Yamamoto, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/070,927

(22) Filed: Oct. 15, 2020

(65) Prior Publication Data

US 2021/0119378 A1 Apr. 22, 2021

(30) Foreign Application Priority Data

Oct. 16, 2019 (JP) ..... JP2019-189367

(51) Int. Cl.
*H01R 13/629* (2006.01)
*H01R 13/52* (2006.01)

(52) U.S. Cl.
CPC ..... *H01R 13/629* (2013.01); *H01R 13/5213* (2013.01)

(58) Field of Classification Search
CPC ..... H01R 13/629; H01R 13/5213; H01R 13/533; H01R 12/771; H01R 13/506; H01R 13/5045; H01R 2201/26
See application file for complete search history.

(56) References Cited

U.S. PATENT DOCUMENTS 5,358,424 A * 10/1994 Bowen ..... H01R 4/2433 29/857
6,482,025 B2 * 11/2002 Yoshida ..... H01R 13/6272 439/382
9,742,115 B2 * 8/2017 Matsumoto ..... H01R 13/629
2009/0311906 A1 * 12/2009 Chen ..... H01R 12/675 439/499

(Continued)

FOREIGN PATENT DOCUMENTS

JP 2005-347082 A 12/2005
JP 2012-094289 A 5/2012
JP 2017-216047 A 12/2017

*Primary Examiner* — Tho D Ta
(74) *Attorney, Agent, or Firm* — Kenealy Vaidya LLP

(57) ABSTRACT

A connector includes a housing in which a terminal fitting is stored, and a cover. A guiding structure configured to guide the housing and the cover in a connection direction, and a holding structure configured to hold the housing and the cover at a connection completed position are provided between the housing and the cover. The guiding structure includes a wedge guiding protrusion provided to the cover, and a wedge guiding groove provided to the housing. The wedge guiding protrusion and the wedge guiding groove are formed to have a gap between a protrusion-side wall surface and a groove-side wall surface disposed opposite to each other in each of two pairs. The holding structure includes a press-fit protrusion being configured to hold the wedge guiding protrusion and the wedge guiding groove in a press-fitted state when the housing and the cover are at the connection completed position.

16 Claims, 10 Drawing Sheets

(56) References Cited

U.S. PATENT DOCUMENTS

| | | | | |
|---|---|---|---|---|
| 2010/0075524 | A1* | 3/2010 | Chazottes | H01R 13/5208 439/275 |
| 2016/0013574 | A1* | 1/2016 | Leonhardt | H01R 13/4362 439/660 |
| 2020/0044376 | A1* | 2/2020 | Ichikawa | H01R 12/778 |

* cited by examiner

CONNECTOR INCLUDING GUIDING STRUCTURE BETWEEN COVER AND HOUSING

CROSS-REFERENCE TO RELATED APPLICATION(S)

The present application claims priority to and incorporates by reference the entire contents of Japanese Patent Application No. 2019-189367 filed in Japan on Oct. 16, 2019.

BACKGROUND OF THE INVENTION

1. Field of the Invention

The present invention relates to a connector.

2. Description of the Related Art

A conventionally known connector includes a housing in which a terminal fitting is stored and a cover that covers the housing from outside. A conductive component (for example, an electrical wire or flexible printed circuit substrate (FPC)) electrically connected with the terminal fitting is connected with the connector and extended outside. The cover is provided to protect the terminal fitting and the conductive component. Such connectors are disclosed in, for example, Japanese Patent Application Laid-open. No. 2005-347082, Japanese Patent Application Laid-open No. 2012-94289, and Japanese Patent Application Laid-open No. 2017-216047.

However, in the connector, upon an external input due to vehicle driving or the like, any backlash between the housing and the cover potentially generates unnecessary sound between the housing and the cover or vibrates the housing and the cover, thereby causing an unwanted situation. The conventional connector has room for improvement in this point.

SUMMARY OF THE INVENTION

Thus, the present invention is intended to provide a connector that can reduce backlash between a housing and a cover.

In order to achieve the above mentioned object, a connector according to one aspect of the present invention includes a terminal fitting; a flexible flat conductive component in which a conductor and an insulator that are flexible are stacked and formed in a flat plane, the conductor being connected with an electrical connection part of the terminal fitting provided perpendicular to the plane; a housing in which a terminal connection part of the terminal fitting is stored and out of which the electrical connection part of the terminal fitting protrudes; and a cover that is connected with the housing through insertion and covers the electrical connection part from outside together with at least part of the housing, wherein a locking structure configured to lock motion of the housing and the cover opposite to a connection direction at a connection completed position, a guiding structure configured to guide the housing and the cover in the connection direction, and a holding structure configured to hold the housing and the cover at the connection completed position are provided between the housing and the cover, the guiding structure includes a wedge guiding protrusion provided to one of the housing and the cover, having a wedge-shaped section orthogonal to the connection direction, and extending in the connection direction, and a wedge guiding groove provided to the other of the housing and the cover, having a wedge-shaped section orthogonal to the connection direction, and extending in the connection direction to guide and be guided by the wedge guiding protrusion being inserted in the connection direction, the wedge guiding protrusion and the wedge guiding groove are formed to have two pairs of a protrusion-side wall surface and a groove-side wall surface disposed opposite to each other and have a gap between the protrusion-side wall surface and the groove-side wall surface of each pair, and the holding structure includes a press-fit protrusion on at least one of the protrusion-side wall surface and the groove-side wall surface disposed opposite to each other in at least one of the two pairs of the protrusion-side wall surface and the groove-side wall surface disposed opposite to each other, the press-fit protrusion being configured to hold the wedge guiding protrusion and the wedge guiding groove in a press-fitted state when the housing and the cover are at the connection completed position.

According to another aspect of the present invention, in the connector, it is possible to configure that the guiding structures are provided at two places between the housing and the cover, the guiding structures at the two places are provided so that a protrude direction of one of the wedge guiding protrusions and a protrude direction of the other of the wedge guiding protrusions are opposite to each other, and the holding structure is provided to each of the guiding structures at the two places.

According to still another aspect of the present invention, in the connector, it is possible to configure that the press-fit protrusion is disposed to provide a gutter along the gap between the wedge guiding protrusion and the wedge guiding groove until the housing and the cover move to the connection completed position and to hold the wedge guiding protrusion and the wedge guiding groove in a press-fitted state after the housing and the cover have moved to the connection completed position.

According to still another aspect of the present invention, in the connector, it is possible to configure that the wedge guiding protrusion has a leading end at a starting point of insertion into the wedge guiding groove in the connection direction, the wedge guiding groove has a leading end at an insertion opening through which the wedge guiding protrusion is inserted in the connection direction from the leading end, and has a back end at a place where the leading end of the wedge guiding protrusion is inserted when the housing and the cover move to the connection completed position, the protrusion-side wall surface of the wedge guiding protrusion includes a back end part that is inserted through the insertion opening when the housing and the cover move to the connection completed position and is positioned opposite to the groove-side wall surface of the wedge guiding groove after the housing and the cover have moved to the connection completed position, the groove-side wall surface of the wedge guiding groove includes, at the back end of the wedge guiding groove, a back end part that is positioned opposite to the protrusion-side wall surface of the leading end of the wedge guiding protrusion after the housing and the cover have moved to the connection completed position, and the press-fit protrusion is provided to the back end part of the protrusion-side wall surface when provided to the protrusion-side wall surface, or is provided to the back end part of the groove-side wall surface when provided to the groove-side wall surface.

According to still another aspect of the present invention, in the connector, it is possible to configure that the wedge guiding protrusion has a leading end at a starting point of insertion into the wedge guiding groove in the connection direction, the wedge guiding groove has a leading end at an insertion opening through which the wedge guiding protrusion is inserted in the connection direction from the leading end, and has a back end at a place where the leading end of the wedge guiding protrusion is inserted when the housing and the cover move to the connection completed position, the protrusion-side wall surface of the wedge guiding protrusion includes a back end part that is inserted through the insertion opening when the housing and the cover move to the connection completed position and is positioned opposite to the groove-side wall surface of the wedge guiding groove after the housing and the cover have moved to the connection completed position, the groove-side wall surface of the wedge guiding groove includes, at the back end of the wedge guiding groove, a back end part that is positioned opposite to the protrusion-side wall surface of the leading end of the wedge guiding protrusion after the housing and the cover have moved to the connection completed position, and the press-fit protrusion is provided to the back end part of the protrusion-side wall surface when provided to the protrusion-side wall surface, or is provided to the back end part of the groove-side wall surface when provided to the groove-side wall surface.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An embodiment of a connector according to the present invention will be described below in detail with reference to the accompanying drawings. The present embodiment does not limit the present invention.

Embodiment

One embodiment of the connector according to the present invention will be described below based on FIGS. 1 to 12.

Figure 1:
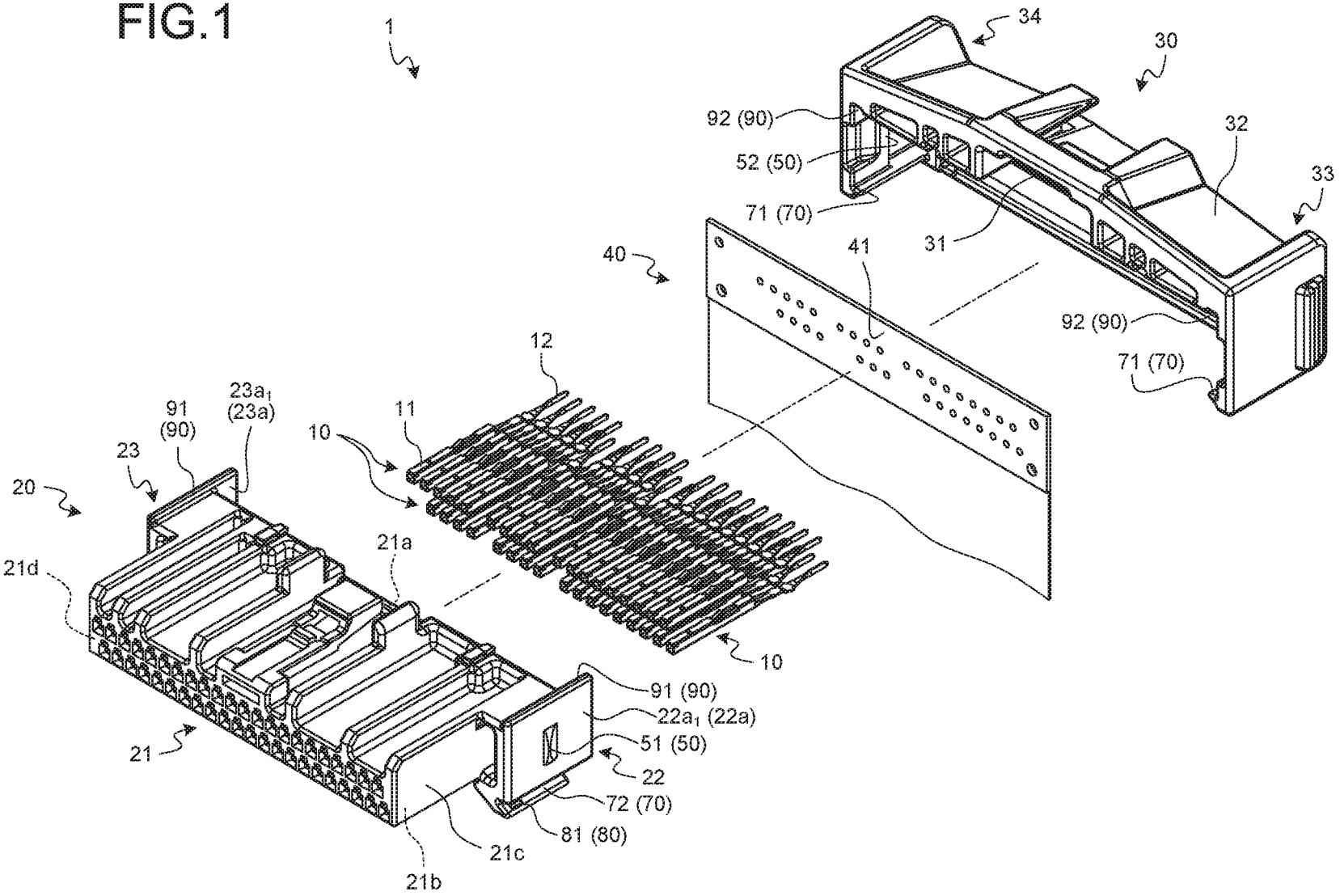
FIG. 1 is an exploded perspective view illustrating a connector of an embodiment.
Figure 2:
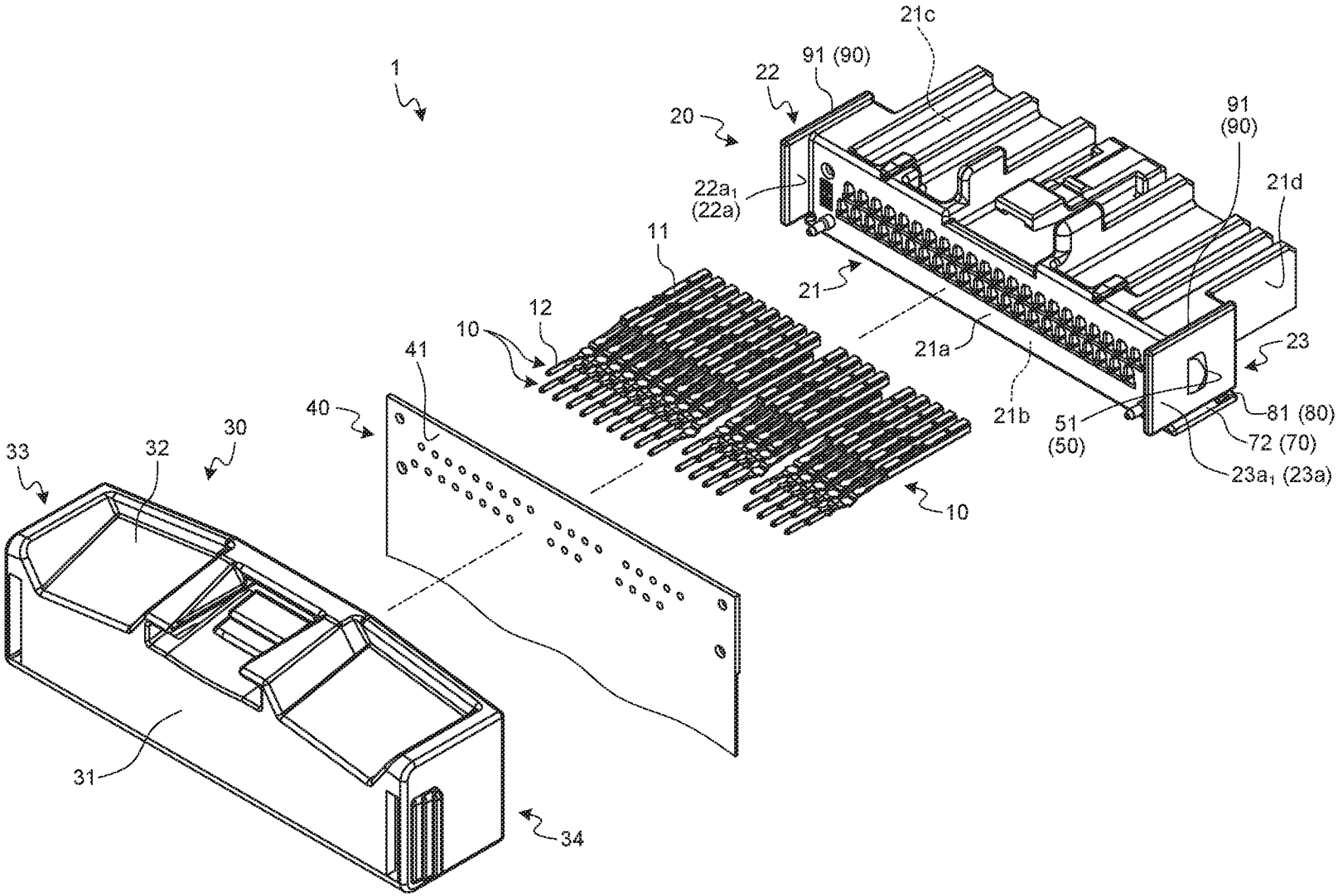
FIG. 2 is an exploded perspective view of the connector of the embodiment when viewed at a different angle.

Reference sign 1 in FIGS. 1 to 6 denotes the connector of the present embodiment. This connector 1 includes a terminal fitting 10, a housing 20 in which the terminal fitting 10 is stored and that is fitted and connected to a counterpart housing (not illustrated) of a counterpart connector in a fitting connection direction, and a cover 30 that is connected with the housing 20 through insertion and covers, from outside, at least part of the housing 20 and a conductive part (to be described later) protruding from the housing 20 (FIGS. 1 and 2).

The terminal fitting 10 is formed of a conductive material such as metal. For example, the terminal fitting 10 is formed of a metal plate as a parent material through press fabrication such as bending and cutting. The terminal fitting 10 includes a terminal connection part 11 that is physically and electrically connected with a counterpart terminal fitting (not illustrated) of the counterpart connector, and an electrical connection part 12 that is physically and electrically connected with a conductive component 40 (FIGS. 1 and 2). The terminal connection part 11 is formed in, for example, a female terminal shape or a male terminal shape.

The conductive component 40 is, for example, an electrical ire having a terminal connected with the electrical connection part 12 inside a housing body 21, or a flexible flat conductive component disposed outside the housing body 21 and connected with the electrical connection part 12 protruding out of the housing body 21. The flexible flat conductive component is a sheet conductive component in which a conductor and an insulator that are flexible (in other words, plastic) are stacked and formed in a flat plane. For example, the flexible flat conductive component includes a plurality of conductors each forming a circuit pattern. The flexible flat conductive component is, for example, a flexible printed circuit substrate (FPC), a printing circuit structure such as a membrane wiring plate, a flat cable (FC), or a flexible flat cable (FFC).

The connector 1 of the present embodiment includes one or a plurality of terminal fittings 10. The connector 1 of this example includes a plurality of terminal fittings 10, and the electrical connection part 12 of each terminal fitting 10 is physically and electrically connected with a rectangular flexible flat conductive component as the conductive component 40. In this example, each conductor (not illustrated) of the conductive component 40 is provided with one terminal fitting 10. The electrical connection part 12 of the terminal fitting 10 is provided perpendicular to the flat plane of the conductive component 40 by inserting the electrical connection part 12 into a through-hole of the conductive component 40 and soldering the electrical connection part 12 to the conductor exposed at the through-hole. In the conductive component 40 of this example, the terminal fittings 10 are connected at one (side 41) of the four sides of the conductive component 40 (FIGS. 1 and 2), and accordingly, the electrical connection parts of the conductors are disposed at the side 41.

The housing 20 is formed of an insulating material such as synthesis resin. The housing 20 of this example includes the housing body 21 in which the terminal fittings 10 are stored (FIGS. 1 to 6). Each terminal fitting 10 is inserted into the housing body 21 in the fitting connection direction from the terminal connection part 11 side. In this example, the housing body 21 as formed in a rectangular parallelepiped shape. The terminal connection part 11 of each terminal fitting 10 is stored inside the housing body 21, and the electrical connection part 12 of each terminal fitting 10 protrudes outward through one (first outer wall surface 21*a* (FIGS. 1 to 3)) of the six outer wall surfaces. In this example, the electrical connection part 12 protrudes toward a first wall 31 (to be described later) of the cover 30 in a direction opposite to the fitting connection direction. Outside the housing body 21, each electrical connection part 12 is soldered to the electrical connection part of the corresponding conductor of the conductive component 40. With the side 41 being disposed opposite to the first outer wall surface 21*a*, the conductive component 40 extends on a second outer wall surface 21*b* side of the housing body 21, which is disposed orthogonal to the first outer wall surface 21*a* (FIGS. 1 to 4).

Figure 3:
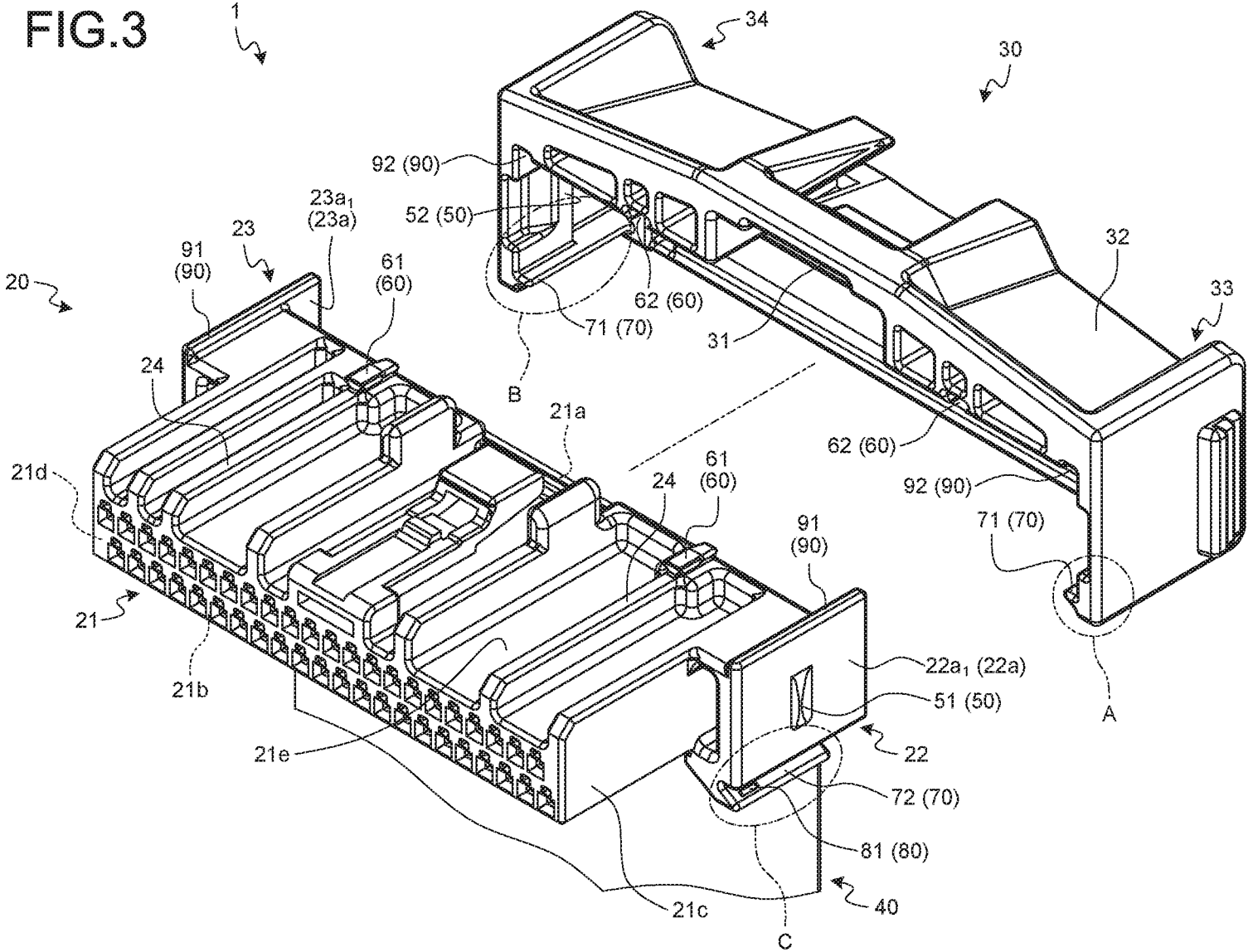
FIG. 3 is an exploded perspective view of the connector before cover connection.
Figure 4:
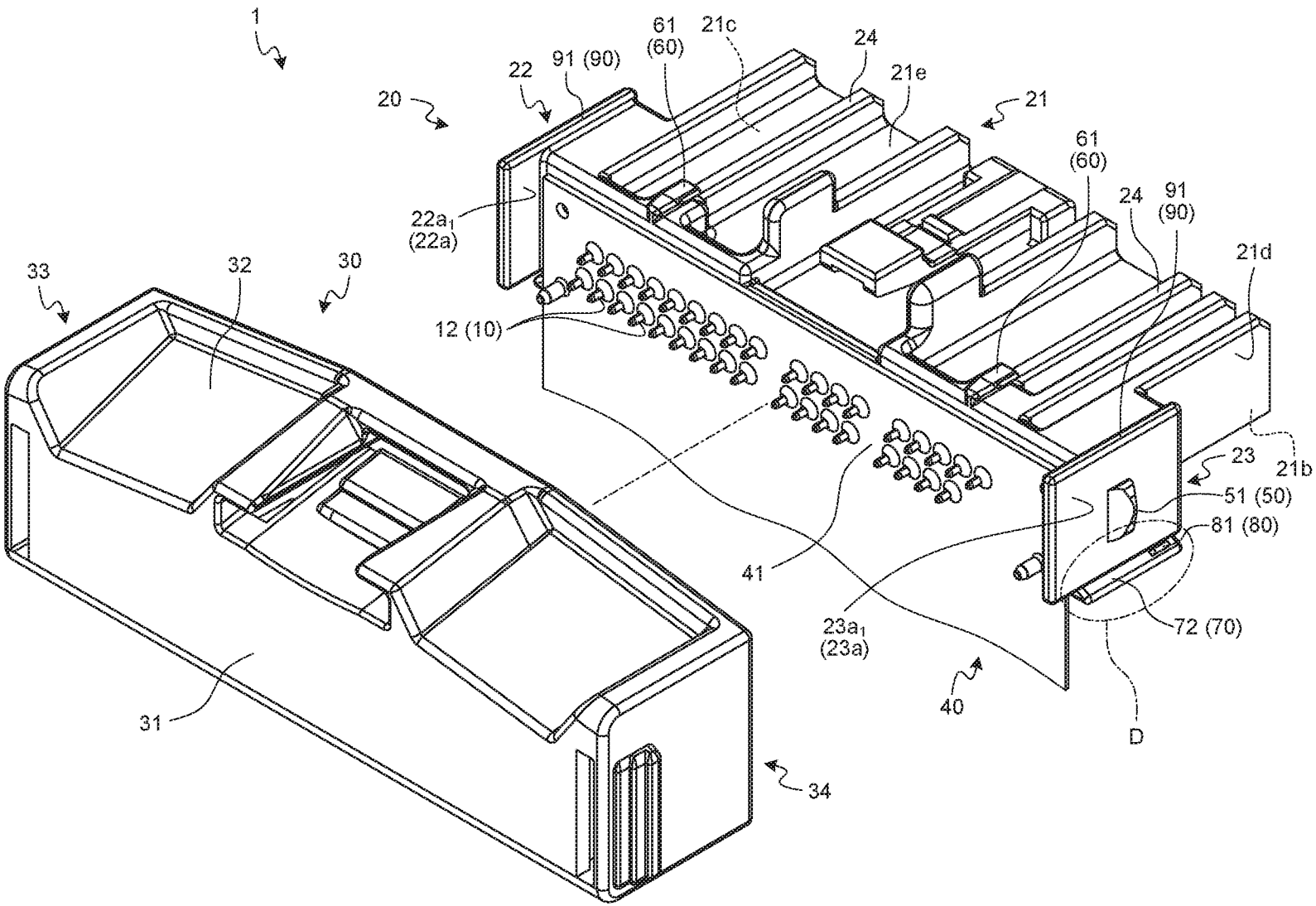
FIG. 4 is an exploded perspective view of the connector before cover connection when viewed at a different angle.
Figure 5:
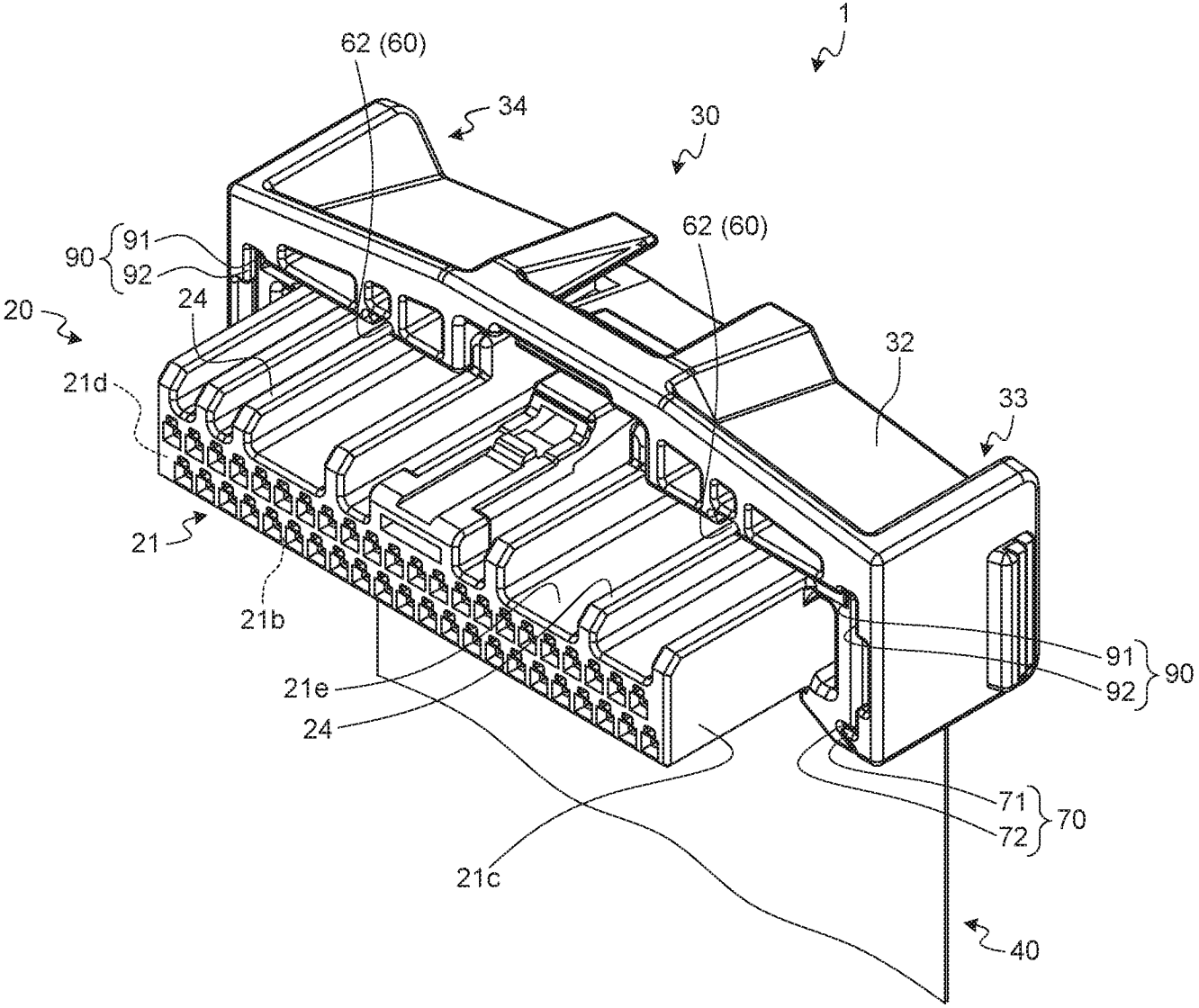
FIG. 5 is a perspective view illustrating the connector of the embodiment.

The housing body 21 includes a third outer wall surface 21*c* and a fourth outer wall surface 21*d* that are disposed orthogonal to the first outer wall surface 21*a* and the second outer wall surface 21*b* (FIGS. 1 to 3). The housing 20 covers and hides the electrical connection part 12 of each terminal fitting 10 and the side 41 (in other words, the electrical connection part of each conductor) of the conductive component 40 from the third outer wall surface 21*c* side and the fourth outer wall surface 21*d* side, thereby protecting these components. For this, the housing 20 includes a first protection body 22 disposed opposite to and coupled with the third outer wall surface 21*c* at an interval, and a second protection body 23 disposed opposite to and coupled with the fourth outer wall surface 21*d* at an interval and protruding further than the first outer wall surface 21*a* (FIGS. 1 to 4 and 6).

The first protection body 22 of this example includes a flat plate part 22*a* having a rectangular flat plate shape, and the flat plane of the flat plate part 22*a* is disposed opposite to the third outer wall surface 21*c* at an interval (FIGS. 1 to 4 and 6). In the first protection body 22, the flat plate part 22*a* includes a protrusion part $22a_1$ protruding further than the first outer wall surface 21*a*, and the protrusion part $22a_1$ covers and hides the electrical connection part 12 of each terminal fitting 10 and the side 41 of the conductive component 40 from the third outer wall surface 21*c* side (FIGS. 1 to 4). The second protection body 23 of this example includes a flat plate part 23*a* having a rectangular flat plate shape, and the flat plane of the flat plate part 23*a* is disposed opposite to the fourth outer wall surface 21*d* at an interval (FIGS. 1 to 4 and 6). In the second protection body 23, the flat plate part 23*a* includes a protrusion part $23a_1$ protruding further than the first outer wall surface 21*a*, and the protrusion part $23a_1$ covers and hides the electrical connection part 12 of each terminal fitting 10 and the side 41 of the conductive component 10 from the fourth outer wall surface 21*d* side (FIGS. 1 to 4).

In the housing 20, a plurality of reinforcement ribs 24 are provided to the housing body 21 (FIGS. 3 to 6). The reinforcement ribs 24 protrude on a fifth outer wall surface 21*e* of the housing body 21. The fifth outer wall surface 21*e* is an outer wall surface of the housing body 21, which is disposed orthogonal to the first outer wall surface 21*a* and disposed on a side opposite to the second outer wall surface 21*b*.

The cover 30 is formed of an insulating material such as synthesis resin. For example, the conductive part covered by the cover 30 is part of an electrical wire as the conductive component 40, which extends from the housing body 21, or is the electrical connection part 12 protruding out of the housing body 21 and the side 41 of the flexible flat conductive component as the conductive component 40. In this example, the conductive part covered by the cover 30 is the electrical connection part 12 of each terminal fitting 10 and the side 41 of the conductive component 40 (electrical connection part of each conductor). The cover 30 covers and hides, with the first wall 31 and a second wall 32, the electrical connection part 12 of each terminal fitting 10 and the side 41 of the conductive component 40, thereby protecting these components (FIGS. 1 to 4). The first wall 31 is disposed opposite to the first outer wall surface 21*a* at an interval, thereby covering and hiding the electrical connection part 12 of each terminal fitting 10 and the side 41 of the conductive component 40. The second wall 32 is provided continuously with the first wall 31 and disposed opposite to the fifth outer wall surface 21*e* at an interval, thereby covering and hiding the electrical connection part 12 of each terminal fitting 10 and the side 41 of the conductive component. 40 from the fifth outer wall surface 21*e* side.

In addition, the cover 30 includes a third wall 33 disposed opposite to the first protection body 22 of the housing 20 to cover the first protection body 22 from outside, and a fourth wall 34 disposed opposite to the second protection body 23 of the housing 20 to cover the second protection body 23 from outside (FIGS. 1 to 4). The third wall 33 and the fourth wall 34 of this example are formed in rectangular flat plate shapes and flexible.

The housing 20 and the cover 30 are inserted and connected with each other in the direction orthogonal to the first outer wall surface 21*a*. In this example, the housing 20 is inserted and connected with the cover 30 from the first cuter wall surface 21*a* side in a direction opposite to the fitting connection direction. When the insertion and connection of the housing 20 and the cover 30 are performed up to a connection completed position, the first outer wall surface 21*a* and the first wall 31 are positioned opposite to each other, the fifth outer wall surface 21*e* and the second wall 32 are positioned opposite to each other, the first protection body 22 and the third wall 33 are positioned opposite to each other, and the second protection body 23 and the fourth wall 34 are positioned opposite to each other.

Figure 7:
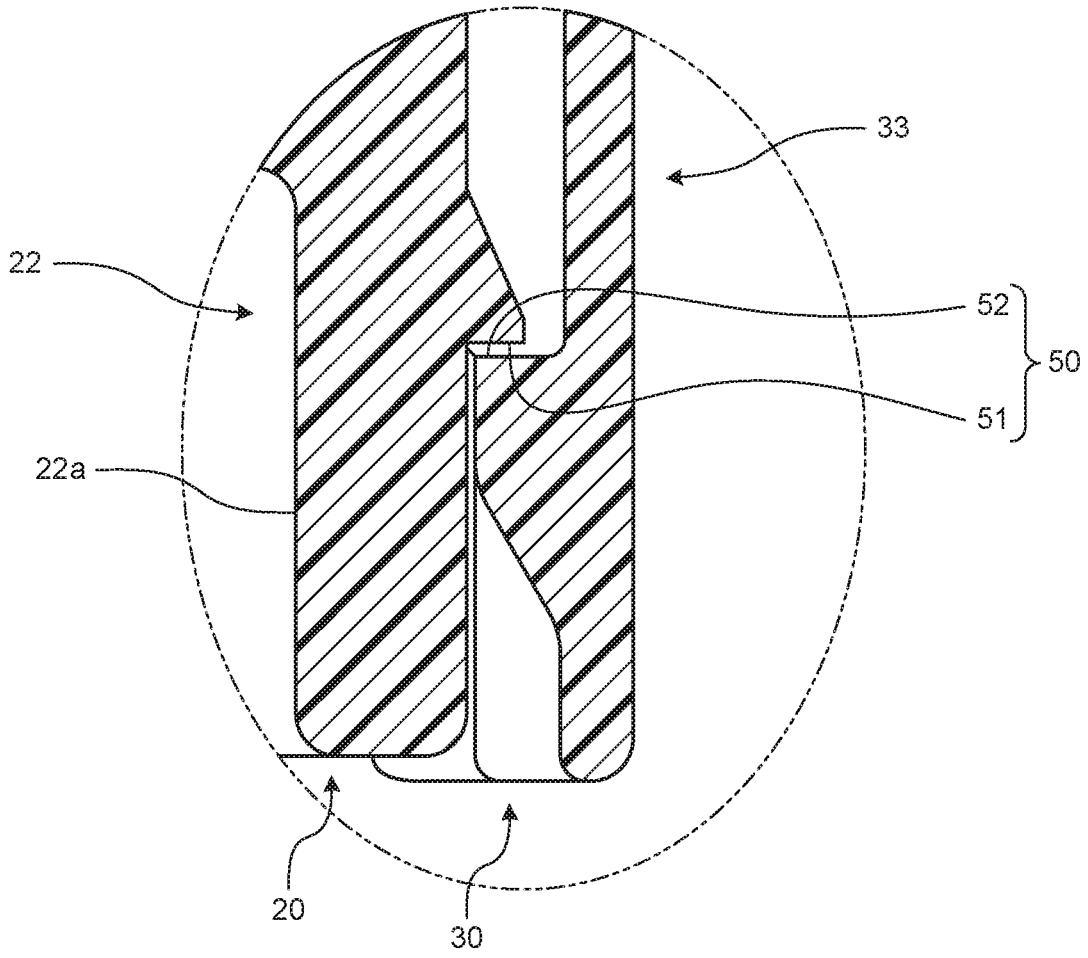
FIG. 7 is a partially enlarged diagram of a section taken along line X-Xin FIG. 6.

A locking structure (hereinafter referred to as "first locking structure") 50 configured to lock motion of the housing and the cover opposite to the connection direction at the connection completed position is provided between the housing 20 and the cover 30 (FIGS. 1 to 3 and 7). The first locking structure 50 includes a first lock body 51 provided to the housing 20, and a second lock body 52 provided to the cover 30 (FIGS. 1, 3, and 7). The first lock body 51 and the second lock body 52 are disposed opposite to each other to lock motion of the housing 20 and the cover 30 opposite to the connection direction when the housing 20 and the cover 30 are at the connection completed position.

In the connector 1 of the present embodiment, the first locking structures 50 are provided at two places: between the first protection body 22 and the third wall 33 and between the second protection body 23 and the fourth wall 34. In this example, each first lock body 51 is formed as a lock protrusion, and each second lock body 52 is formed as a lock wall that is engaged with the first lock body 51. The first lock body 51 protrudes outward from the outer wall surface of the corresponding one of the first protection body 22 and the second protection body 23. The second lock body 52 is formed at the inner wall surface of the corresponding one of the third wall 33 and the fourth wall 34. The first locking structures 50 at the two places are provided so that the first lock bodies 51 thereof protrude in directions opposite to each other.

Figure 6:
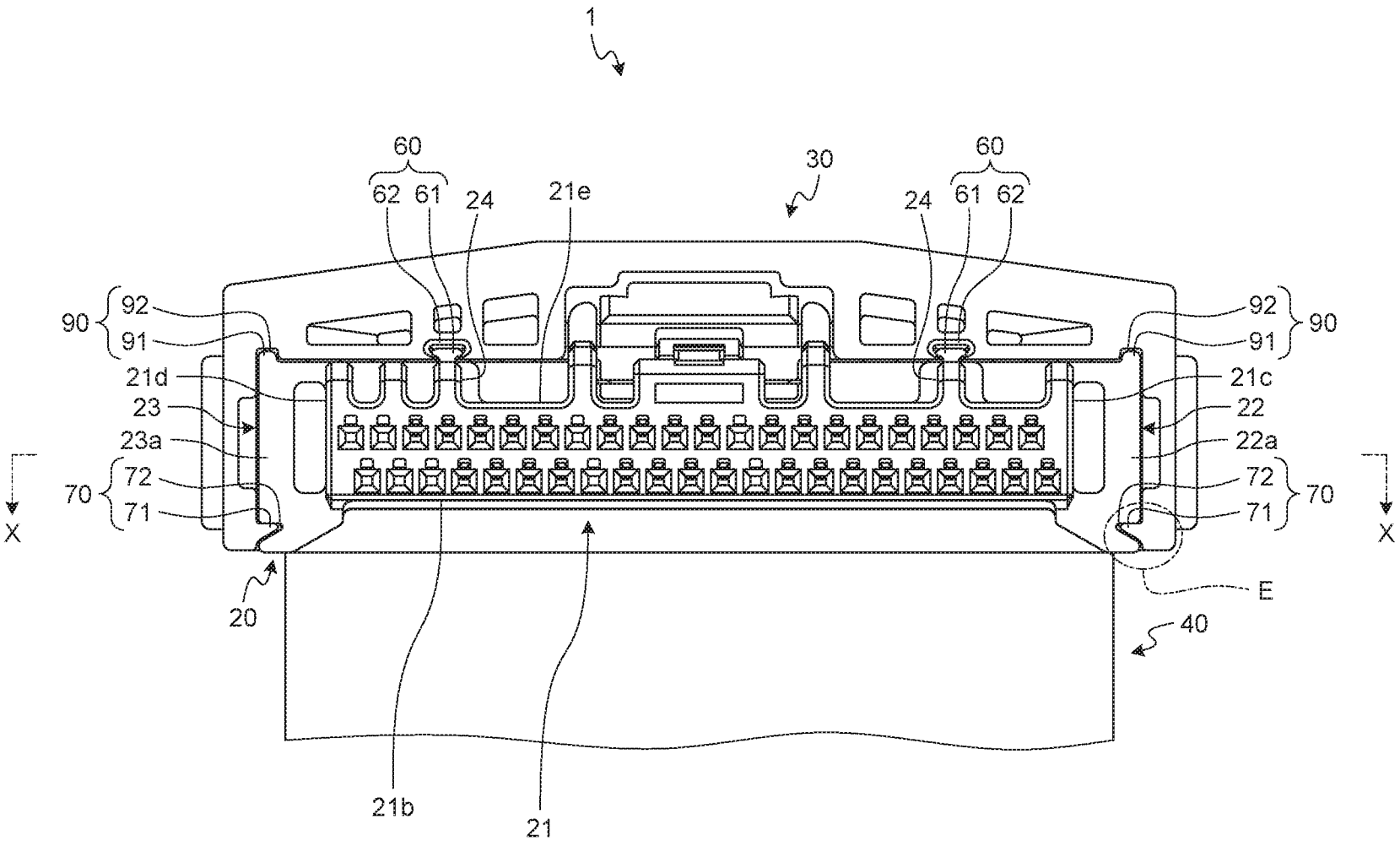
FIG. 6 is a plan view illustrating the connector of the embodiment.

In addition, a locking structure (hereinafter referred to as "second locking structure") 60 configured to lock motion of the housing 20 and the cover 30 in a separation direction among directions orthogonal to the connection direction at the connection completed position is provided between the housing 20 and the cover 30 (FIGS. 3 to 6). The second locking structure 60 includes a first lock body 61 provided to the housing 20, and a second lock body 62 provided to the cover 30 (FIGS. 3 and 6).

In the second locking structure 60 of this example, the first lock body 61 as a lock protrusion protrudes from the reinforcement ribs 24, and the second lock body 62 as a lock groove that is engaged with the first lock body 61 is formed at the second wall 32 of the cover 30. The first lock body 61 and the second lock body 62 each have a stereoscopic shape having a substantially trapezoid section orthogonal to the connection direction of the housing 20 and the cover 30 and extending in the connection direction. In each of the first lock body 61 and the second lock body 62, the upper base of the substantially trapezoid orthogonal section is positioned on the fifth outer wall surface 21*e* side. With this configuration, the first lock body 61 and the second lock body 62 lock motion of the housing 20 and the cover 30 in the separation direction when the housing 20 and the cover 30 are at the connection completed position. The first lock body 61 and the second lock body 62 also serve as a guiding structure for connecting the housing 20 and the cover 30 through insertion. The connector 1 of the present embodiment includes the second locking structures 60 at two places.

In addition, a guiding structure (hereinafter referred to as "first guiding structure") 70 configured to guide the housing 20 and the cover 30 in the connection direction is provided between the housing 20 and the cover 30 (FIGS. 1 to 6 and 8 to 12). The first guiding structure 70 includes a wedge guiding protrusion 71 that is a protrusion provided to one of the housing 20 and the cover 30, has a wedge-shaped section orthogonal to the connection direction, and extends in the connection direction, and a wedge guiding groove 72 that is a groove provided to the other of the housing 20 and the cover 30, has a wedge-shaped section orthogonal to the connection direction, and extends in the connection direction to guide and be guided by the wedge guiding protrusion 71 being inserted in the connection direction (FIGS. 1, 3, 5, 6, and 12).

The wedge guiding protrusion 71 and the wedge guiding groove 72 are formed to have two pairs of a protrusion-side wall surface 71*a* and a groove-side wall surface 72*a* disposed opposite to each other (FIGS. 8 to 12) and have a gap between the protrusion-side wall surface 71*a* and the groove-side wall surface 72*a* of each pair.

Figure 8:
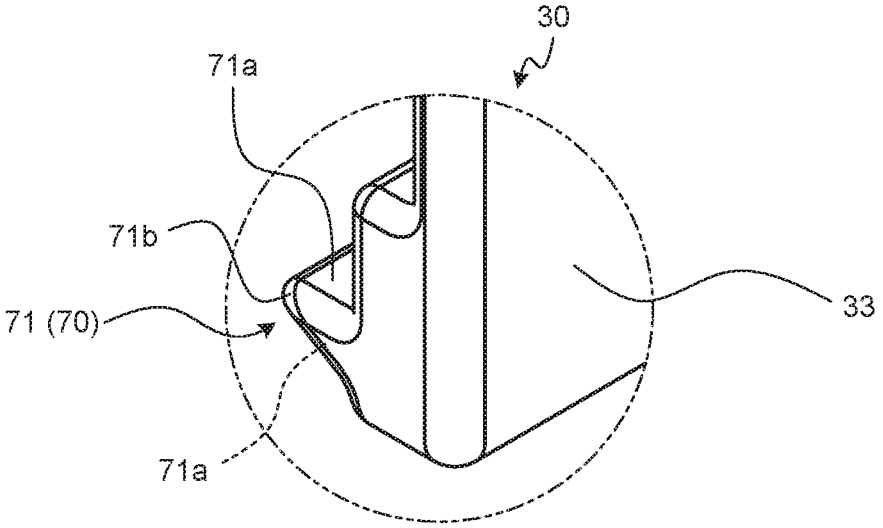
FIG. 8 is an enlarged view of Part A in FIG. 3.
Figure 9:
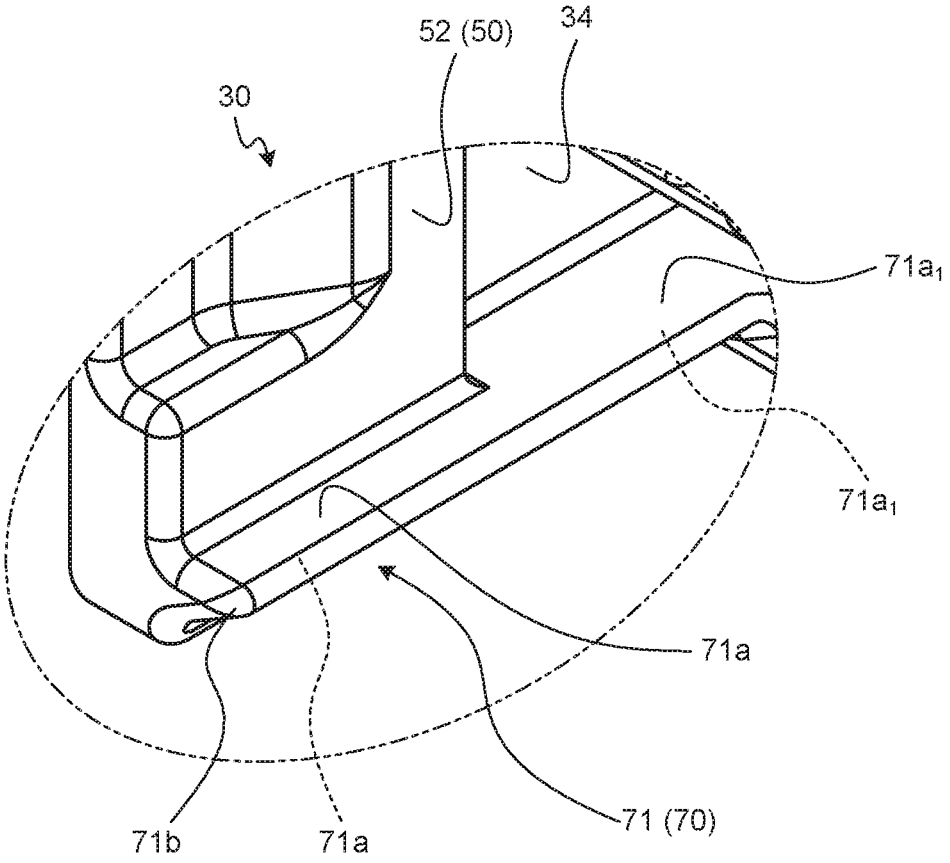
FIG. 9 is an enlarged view of Part B in FIG. 3.
Figure 10:
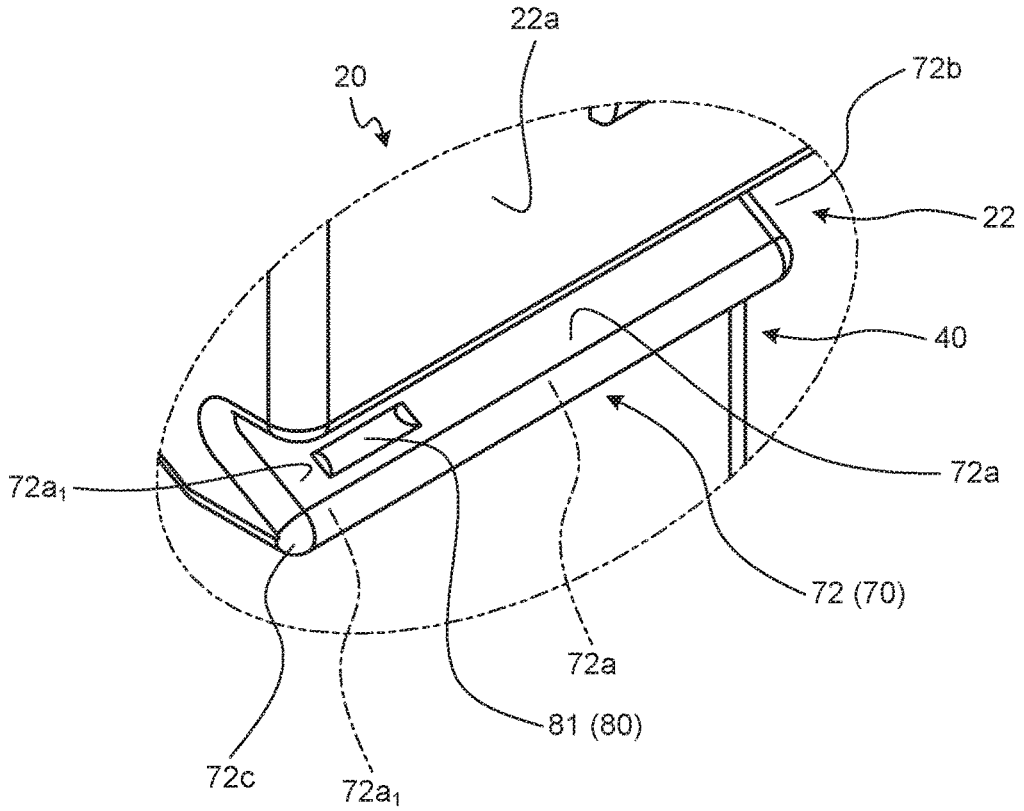
FIG. 10 is an enlarged view of Part C in FIG. 3.
Figure 11:
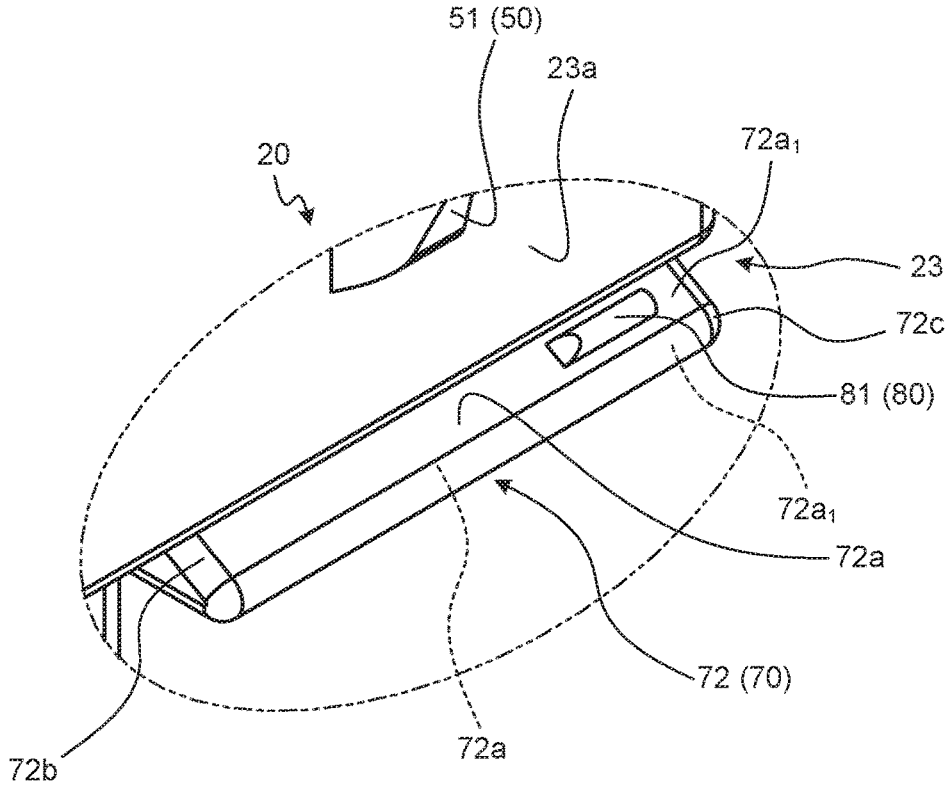
FIG. 11 is an enlarged view of Part D in FIG. 4.
Figure 12:
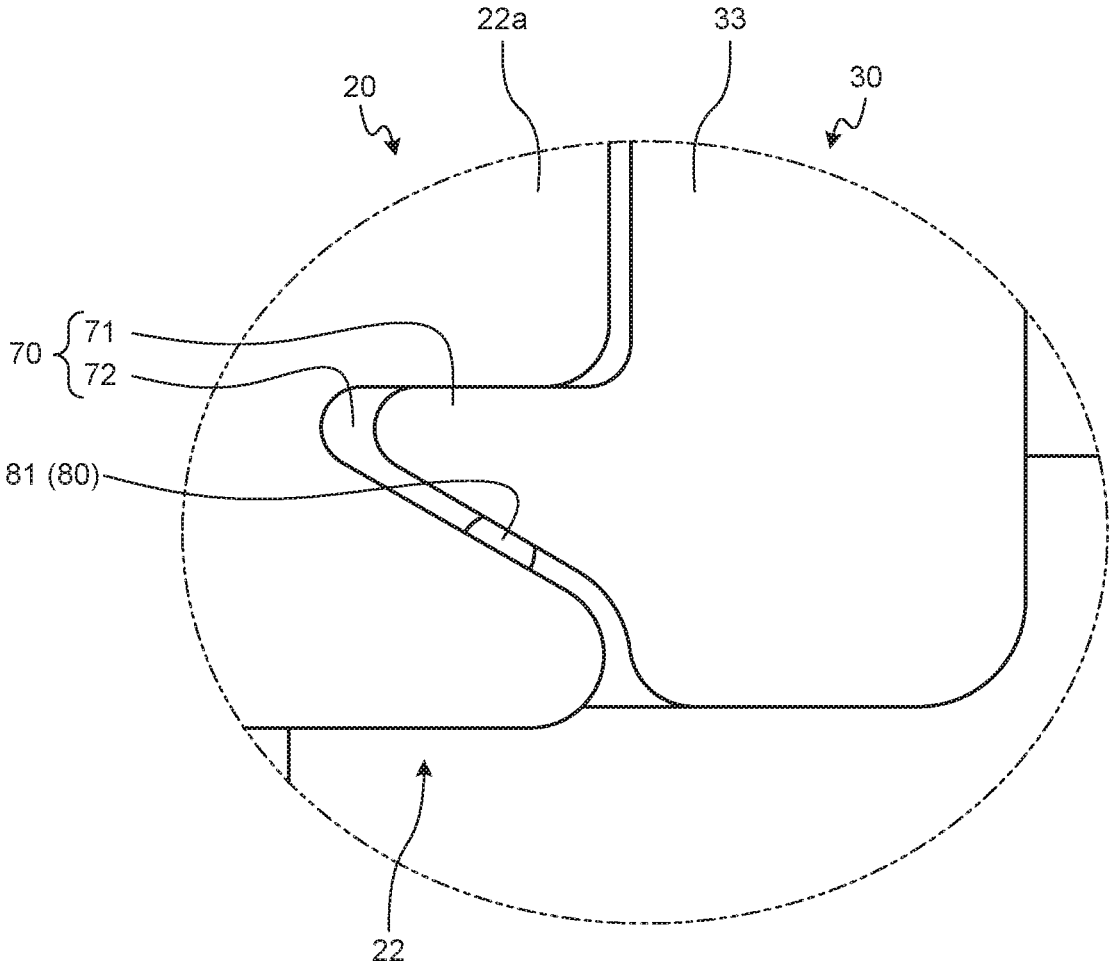
FIG. 12 is an enlarged view of Part E in FIG. 6.

The wedge guiding protrusion 71 of this example has a leading end 71*b* at the starting point of insertion into the wedge guiding groove 72 in the connection direction. (FIGS. 8 and 9). The wedge guiding groove 72 of this example has a leading end at an insertion opening 72*b* through which the wedge guiding protrusion 71 is inserted in the connection direction from the leading end 71*b*, and has a back end 72*c* at a place where the leading end 71*b* of the wedge guiding protrusion 71 is inserted when the housing 20 and the cover 30 move to the connection completed position (FIGS. 10 and 11). The protrusion-side wall surface 71*a* of the wedge guiding protrusion 71 includes a back end part $71a_1$ that is inserted through the insertion opening 72*b* when the housing 20 and the cover 30 move to the connection completed position and is positioned opposite to the groove-side wall surface 72*a* of the wedge guiding groove 72 after the housing 20 and the cover 30 have moved to the connection completed position (FIG. 9). The groove-side wall surface 72*a* of the wedge guiding groove 72 includes, at the back end 72*c* of the wedge guiding groove 72, a back end part $72a_1$ that is positioned opposite to the protrusion-side wall surface 71*a* of the leading end 71*b* of the wedge guiding protrusion 71 after the housing 20 and the cover 30 have moved to the connection completed position (FIGS. 10 and 11).

The first guiding structures 70 are provided at two places between the housing 20 and the cover 30 of this example. The first guiding structures 70 at the two places are provided so that the wedge guiding protrusions 71 protrude in directions opposite to each other. The wedge guiding protrusions 71 of this example are provided to the third wall 33 and the fourth wall 34 of the cover 30. In this example, the wedge guiding protrusions 71 are disposed opposite to each other and formed at sides of the rectangular third wall 33 and the rectangular fourth wall 34. The wedge guiding grooves 72 of this example are provided to the first protection body 22 and the second protection body 23 of the housing 20. The wedge guiding groove 72 of the first protection body 22 is disposed adjacent to the flat plate part 22*a* in the flat plane direction of the flat plate part 22*a*. The wedge guiding groove 72 of the second protection body 23 is disposed adjacent to the flat plate part 23*a* in the flat plane direction of the flat plate part 23*a*.

In addition, a holding structure 80 configured to hold the housing 20 and the cover 30 at the connection completed position is provided between the housing 20 and the cover 30 (FIGS. 1 to 4 and 10 to 12). The holding structure 80 includes a press-fit protrusion 81 on at least one of the protrusion-side wall surface 71*a* and the groove-side wall surface 72*a* disposed opposite to each other in at least one of the two pairs, the press-fit protrusion 81 being configured to hold the corresponding wedge guiding protruded 71 and groove 72 in a press-fitted state when the housing 20 and the cover 30 are at the connection completed position. Accordingly, in the connector 1, backlash due to the gap between each wedge guiding protrusion 71 and the corresponding wedge guiding groove 72 is reduced when the housing 20 and the cover 30 are at the connection completed position. Thus, in the connector 1, generation of unnecessary sound between the housing 20 and the cover 30, for example, when an external input due to vehicle driving or the like is applied is reduced. Moreover, in the connector 1, generation of vibration of the housing 20 and the cover 30 attributable to backlash when such an external input is applied is reduced, and thus degradation of durability of the housing 20 and the cover 30 can be reduced. Accordingly, the connector 1 of the present embodiment can have improved sound-vibration reduction capability.

The holding structures 80 of this example are provided to the first guiding structures 70 at the two places. In this example, the press-fit protrusion 81 is formed as a protrusion on one of the two groove-side wall surfaces 72*a* of the wedge guiding groove 72 of each of the first guiding structures 70 at the two places.

The press-fit protrusion 81 is desirably disposed to provide a gutter along the gap between the wedge guiding protrusion 71 and the wedge guiding groove 72 until the housing 20 and the cover 30 move to the connection completed position and to hold the wedge guiding protrusion 71 and the wedge guiding groove 72 in a press-fitted state after the housing 20 and the cover 30 have moved to the connection completed position. For example, the press-fit protrusion 81 is provided to the back end part $71a_1$ of the protrusion-side wall surface 71*a* when provided to the protrusion-side wall surface 71*a*, or is provided to the back end part $72a_1$ of the groove-side wall surface 72*a* when provided to the groove-side wall surface 72*a*. Accordingly, in the connector 1, friction resistance between the wedge guiding protrusion 71 and the wedge guiding groove 72 is reduced until the housing 20 and the cover 30 move to the connection completed position. In particular, in the connector 1, the wedge guiding protrusion 71 and the wedge guiding groove 72 have wedge shapes in each of the first guiding structures 70 at the two places. Thus, the number of wall surfaces (pairs of the protrusion-side wall surface 71*a* and the groove-side wall surface 72*a* disposed opposite to each other) that are likely to contact at connection through insertion is four, which is a small number, and accordingly, the effect of reducing friction resistance between the wedge guiding protrusion 71 and the wedge guiding groove 72 is high. Thus, in the connector 1, insertion force when the housing 20 and the cover 30 are to be connected with each other through insertion is reduced until the housing 20 and the cover 30 move to the connection completed position, which leads to improved operability of connecting the housing 20 and the cover 30. Moreover, in the connector 1, the wedge guiding protruded 71 and the wedge guiding groove 72 are held in a press-fitted state by the press-fit protrusion 81 after the housing 20 and the cover 30 have moved to the connection completed position, which can reduce backlash between the wedge guiding protrusion 71 and the wedge guiding groove 72. Thus, in the connector 1, the generation of unnecessary sound and the generation of vibration described above when the housing 20 and the cover 30 are at the connection completed position can be reduced. In this manner, the connector 1 can achieve both improvement of the operability of connecting the housing 20 and the cover 30 and improvement of the sound-vibration reduction capability.

In this example, the press-fit protrusion 81 is provided to the back end part 72$a_1$ of the groove-side wall surface 72*a* (FIGS. 10 and 11).

Moreover, in addition to each first guiding structure 70, a second guiding structure 90 configured to start guiding of the housing 20 and the cover 30 in the connection direction without contact of the cover 30 with a protrusion part (the electrical connection part 12) of each terminal fitting 10 before guiding by the wedge guiding protrusion 71 and the wedge guiding groove 72 of the first guiding structure 70 is provided between the housing 20 and the cover 30 of this example (FIGS. 1 to 6). The second guiding structure 90 includes a guiding protrusion 91 that is a protrusion provided to one of the housing 20 and the cover 30 and extends in the connection direction, and a guiding groove 92 that is a groove provided to the other of the housing 20 and the cover 30 and extends in the connection direction to guide and be guided by the guiding protrusion 91 being inserted in the connection direction, (FIGS. 1, 3, 5, and 6). Accordingly, in the connector 1, the guiding protrusion 91 and the guiding groove 92 start guiding of the housing 20 and the cover 30 in the connection direct ion without contact of the cover 30 with the protrusion part (electrical connection part 12) of each terminal fitting 10. Thus, the connector 1 can reduce degradation of durability of each terminal fitting 10 and the cover 30. The guiding protrusion 91 and the guiding groove 92 are desirably formed as the first components that contact each other between the housing 20 and the cover 30 when the housing 20 and the cover 30 are to be connected with each other through insertion.

The second guiding structure 90 of this example is provided for each first guiding structure 70 and disposed adjacent to the first guiding structure 70. In this example, the guiding protrusions 91 are provided to the flat plate part 22*a* of the first protection body 22 and the flat plate part 23*a* of the second protection body 23 in the housing 20. In this example, each guiding protrusion 91 is a side of the corresponding one of the rectangular flat plate parts 22*a* and 23*a* in the connection direction. In this example, the guiding grooves 92 are provided to the third wall 33 and the fourth wall 34 of the cover 30. Each guiding groove 92 extends in the connection direction.

In the connector 1, when the housing 20 and the cover 30 are to be connected with each other through insertion, the guiding protrusions 91 on the protrusion parts 22$a_1$ and 23$a_1$ side of the flat plate parts 22*a* and 23*a* start insertion into the guiding grooves 92, and the housing 20 and the cover 30 are guided in the connection direction by the guiding protrusions 91 and the guiding grooves 92. Subsequently, in the connector 1, the wedge guiding protrusions 71 start insertion into the wedge guiding grooves 72, and the housing 20 and the cover 30 are guided in the connection direction by the wedge guiding protrusions 71 and the wedge guiding grooves 72. Thereafter, in the connector 1, the first lock bodies 51 of the housing 20 deform the third wall 33 and the fourth wall 34 of the cover 30. When the housing 20 and the cover 30 have moved to the connection completed position, the deformation of the third wall 33 and the fourth wall 34 is canceled, and the first lock bodies 51 are positioned opposite to the second lock bodies 52 of the third wall 33 and the fourth wall 34. In addition, in the connector 1, after the housing 20 and the cover 30 have moved to the connection completed position, each first lock body 61 and the corresponding second lock body 62 are in a lockable state.

As described above, degradation of durability of the connector 1 of the present embodiment can be reduced since backlash is reduced when the housing 20 and the cover 30 are at the connection completed position. In addition, degradation of durability of each terminal fitting 10 and the cover 30 in the connector 1 of the present embodiment can be reduced since the second guiding structure 90 is provided.

In a connector according to the present embodiment, the press-fit protrusion of the holding structure reduces backlash due to the gap between the wedge guiding protrusion and the wedge guiding groove when the housing and the cover are at the connection completed position. Thus, in the connector, generation of unnecessary sound between the housing and the cover, for example, when an external input due to vehicle driving or the like is applied is reduced. Moreover, in the connector, generation of vibration of the housing and the cover attributable to backlash when such an external input is applied is reduced, and thus degradation of durability of the housing and the cover can be reduced. Accordingly, the connector according to the present embodiment can have improved sound-vibration reduction capability.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a terminal fitting;

a flexible flat conductive component in which a conductor and an insulator that are flexible are stacked and formed in a flat plane, the conductor being connected with an electrical connection part of the terminal fitting provided perpendicular to the flat plane;

a housing in which a terminal connection part of the terminal fitting is stored and out of which the electrical connection part of the terminal fitting protrudes; and a cover that is connected with the housing by moving one of the cover and the housing in a connection direction that is toward another of the cover and the housing, and the cover covers the electrical connection part from outside together with at least part of the housing, wherein a locking structure configured to lock motion between the housing and the cover opposite to the connection direction when the housing and the cover are at a connection completed position, a guiding structure configured to guide the housing and the cover in the connection direction, and a holding structure configured to hold the housing and the cover at the connection completed position are provided between the housing and the cover, the guiding structure includes a wedge guiding protrusion provided to one of the housing and the cover, having a wedge-shaped section orthogonal to the connection direction, and extending in the connection direction, and a wedge guiding groove provided to the other of the housing and the cover, having a wedge-shaped section orthogonal to the connection direction, and extending in the connection direction to guide and be guided by the wedge guiding protrusion being inserted in the connection direction, the wedge guiding protrusion and the wedge guiding groove are formed to have two pairs of a protrusion-side wall surface and a groove-side wall surface disposed opposite to each other and have a gap between the protrusion-side wall surface and the groove-side wall surface of each pair, and the holding structure includes a press-fit protrusion on at least one of the protrusion-side wall surface and the groove-side wall surface disposed opposite to each other in at least one of the two pairs of the protrusion-side wall surface and the groove-side wall surface disposed opposite to each other, the press-fit protrusion being configured to hold the wedge guiding protrusion and the wedge guiding groove in a press-fitted state when the housing and the cover are at the connection completed position.

2. The connector according to claim 1, wherein the guiding structures are provided at two places between the housing and the cover, the guiding structures at the two places are provided so that a protrude direction of one of the wedge guiding protrusions and a protrude direction of the other of the wedge guiding protrusions are opposite to each other, and the holding structure is provided to each of the guiding structures at the two places.

3. The connector according to claim 1, wherein the press-fit protrusion is disposed to provide a gutter along the gap between the wedge guiding protrusion and the wedge guiding groove until the housing and the cover move to the connection completed position and to hold the wedge guiding protrusion and the wedge guiding groove in a press-fitted state after the housing and the cover have moved to the connection completed position.

4. The connector according to claim 2, wherein the press-fit protrusion is disposed to provide a gutter along the gap between the wedge guiding protrusion and the wedge guiding groove until the housing and the cover move to the connection completed position and to hold the wedge guiding protrusion and the wedge guiding groove in a press-fitted state after the housing and the cover have moved to the connection completed position.

5. The connector according to claim 1, wherein the wedge guiding protrusion has a leading end at a starting point of insertion into the wedge guiding groove in the connection direction, the wedge guiding groove has a leading end at an insertion opening through which the wedge guiding protrusion is inserted in the connection direction from the leading end, and has a back end at a place where the leading end of the wedge guiding protrusion is inserted when the housing and the cover move to the connection completed position, the protrusion-side wall surface of the wedge guiding protrusion includes a back end part that is inserted through the insertion opening when the housing and the cover move to the connection completed position and is positioned opposite to the groove-side wall surface of the wedge guiding groove after the housing and the cover have moved to the connection completed position, the groove-side wall surface of the wedge guiding groove includes, at the back end of the wedge guiding groove, a back end part that is positioned opposite to the protrusion-side wall surface of the leading end of the wedge guiding protrusion after the housing and the cover have moved to the connection completed position, and the press-fit protrusion is provided to the back end part of the protrusion-side wall surface when provided to the protrusion-side wall surface, or is provided to the back end part of the groove-side wall surface when provided to the groove-side wall surface.

6. The connector according to claim 2, wherein the wedge guiding protrusion has a leading end at a starting point of insertion into the wedge guiding groove in the connection direction, the wedge guiding groove has a leading end at an insertion opening through which the wedge guiding protrusion is inserted in the connection direction from the leading end, and has a back end at a place where the leading end of the wedge guiding protrusion is inserted when the housing and the cover move to the connection completed position, the protrusion-side wall surface of the wedge guiding protrusion includes a back end part that is inserted through the insertion opening when the housing and the cover move to the connection completed position and is positioned opposite to the groove-side wall surface of the wedge guiding groove after the housing and the cover have moved to the connection completed position, the groove-side wall surface of the wedge guiding groove includes, at the back end of the wedge guiding groove, a back end part that is positioned opposite to the protrusion-side wall surface of the leading end of the wedge guiding protrusion after the housing and the cover have moved to the connection completed position, and the press-fit protrusion is provided to the back end part of the protrusion-side wall surface when provided to the protrusion-side wall surface, or is provided to the back end part of the groove-side wall surface when provided to the groove-side wall surface.

7. The connector according to claim 3, wherein the wedge guiding protrusion has a leading end at a starting point of insertion into the wedge guiding groove in the connection direction, the wedge guiding groove has a leading end at an insertion opening through which the wedge guiding protrusion is inserted in the connection direction from the leading end, and has a back end at a place where the leading end of the wedge guiding protrusion is inserted when the housing and the cover move to the connection completed position, the protrusion-side wall surface of the wedge guiding protrusion includes a back end part that is inserted through the insertion opening when the housing and the cover move to the connection completed position and is positioned opposite to the groove-side wall surface of the wedge guiding groove after the housing and the cover have moved to the connection completed position, the groove-side wall surface of the wedge guiding groove includes, at the back end of the wedge guiding groove, a back end part that is positioned opposite to the protrusion-side wall surface of the leading end of the wedge guiding protrusion after the housing and the cover have moved to the connection completed position, and the press-fit protrusion is provided to the back end part of the protrusion-side wall surface when provided to the protrusion-side wall surface, or is provided to the back end part of the groove-side wall surface when provided to the groove-side wall surface.

8. The connector according to claim 4, wherein the wedge guiding protrusion has a leading end at a starting point of insertion into the wedge guiding groove in the connection direction, the wedge guiding groove has a leading end at an insertion opening through which the wedge guiding protrusion is inserted in the connection direction from the leading end, and has a back end at a place where the leading end of the wedge guiding protrusion is inserted when the housing and the cover move to the connection completed position, the protrusion-side wall surface of the wedge guiding protrusion includes a back end part that is inserted through the insertion opening when the housing and the cover move to the connection completed position and is positioned opposite to the groove-side wall surface of the wedge guiding groove after the housing and the cover have moved to the connection completed position, the groove-side wall surface of the wedge guiding groove includes, at the back end of the wedge guiding groove, a back end part that is positioned opposite to the protrusion-side wall surface of the leading end of the wedge guiding protrusion after the housing and the cover have moved to the connection completed position, and the press-fit protrusion is provided to the back end part of the protrusion-side wall surface when provided to the protrusion-side wall surface, or is provided to the back end part of the groove-side wall surface when provided to the groove-side wall surface.

9. The connector according to claim 1, wherein the terminal fitting protrudes out of the housing toward the cover, and in addition to a first guiding structure serving as the guiding structure, a second guiding structure configured to start guiding in the connection direction without contact of the cover with a protrusion part of the terminal fitting before guiding by the wedge guiding protrusion and the wedge guiding groove of the first guiding structure is provided between the housing and the cover.

10. The connector according to claim 2, wherein the terminal fitting protrudes out of the housing toward the cover, and in addition to a first guiding structure serving as the guiding structure, a second guiding structure configured to start guiding in the connection direction without contact of the cover with a protrusion part of the terminal fitting before guiding by the wedge guiding protrusion and the wedge guiding groove of the first guiding structure is provided between the housing and the cover.

11. The connector according to claim 3, wherein the terminal fitting protrudes out of the housing toward the cover, and in addition to a first guiding structure serving as the guiding structure, a second guiding structure configured to start guiding in the connection direction without contact of the cover with a protrusion part of the terminal fitting before guiding by the wedge guiding protrusion and the wedge guiding groove of the first guiding structure is provided between the housing and the cover.

12. The connector according to claim 4, wherein the terminal fitting protrudes out of the housing toward the cover, and in addition to a first guiding structure serving as the guiding structure, a second guiding structure configured to start guiding in the connection direction without contact of the cover with a protrusion part of the terminal fitting before guiding by the wedge guiding protrusion and the wedge guiding groove of the first guiding structure is provided between the housing and the cover.

13. The connector according to claim 5, wherein the terminal fitting protrudes out of the housing toward the cover, and in addition to a first guiding structure serving as the guiding structure, a second guiding structure configured to start guiding in the connection direction without contact of the cover with a protrusion part of the terminal fitting before guiding by the wedge guiding protrusion and the wedge guiding groove of the first guiding structure is provided between the housing and the cover.

14. The connector according to claim 6, wherein the terminal fitting protrudes out of the housing toward the cover, and in addition to a first guiding structure serving as the guiding structure, a second guiding structure configured to start guiding in the connection direction without contact of the cover with a protrusion part of the terminal fitting before guiding by the wedge guiding protrusion and the wedge guiding groove of the first guiding structure is provided between the housing and the cover.

15. The connector according to claim 7, wherein the terminal fitting protrudes out of the housing toward the cover, and in addition to a first guiding structure serving as the guiding structure, a second guiding structure configured to start guiding in the connection direction without contact of the cover with a protrusion part of the terminal fitting before guiding by the wedge guiding protrusion and the wedge guiding groove of the first guiding structure is provided between the housing and the cover.

16. The connector according to claim 8, wherein the terminal fitting protrudes out of the housing toward the cover, and in addition to a first guiding structure serving as the guiding structure, a second guiding structure configured to start guiding in the connection direction without contact of the cover with a protrusion part of the terminal fitting before guiding by the wedge guiding protrusion and the wedge guiding groove of the first guiding structure is provided between the housing and the cover.

* * * * *